US010006178B2

(12) United States Patent
Intagliata et al.

(10) Patent No.: US 10,006,178 B2
(45) Date of Patent: Jun. 26, 2018

(54) SELF-RIGHTING FLEXIBLE DELINEATOR WITH PROTECTIVE COLLAR

(71) Applicant: ENERGY ABSORPTION SYSTEMS, INC., Dallas, TX (US)

(72) Inventors: John D. Intagliata, Antelope, CA (US); Kevin Newton, Pell City, AL (US); John W. Higgins, Pell City, AL (US); Kent Kekeis, St. John, IN (US)

(73) Assignee: ENERGY ABSORPTION SYSTEMS, INC., Dallas, TX (US)

( * ) Notice: Subject to any disclaimer, the term of this patent is extended or adjusted under 35 U.S.C. 154(b) by 0 days. days.

(21) Appl. No.: 15/170,371

(22) Filed: Jun. 1, 2016

(65) Prior Publication Data

US 2016/0273175 A1 Sep. 22, 2016

Related U.S. Application Data

(63) Continuation of application No. 14/209,020, filed on Mar. 13, 2014, now Pat. No. 9,371,619.

(60) Provisional application No. 61/779,704, filed on Mar. 13, 2013, provisional application No. 61/886,394, filed on Oct. 3, 2013.

(51) Int. Cl.

| | |
|---|---|
| ***E01F 9/017*** | (2006.01) |
| ***E01F 9/627*** | (2016.01) |
| ***E01F 9/608*** | (2016.01) |
| ***E01F 9/685*** | (2016.01) |
| ***E01F 9/588*** | (2016.01) |
| ***E01F 9/681*** | (2016.01) |
| *E02D 5/80* | (2006.01) |

(52) U.S. Cl.

CPC ..... *E01F 9/629* (2016.02); *E01F 9/588* (2016.02); *E01F 9/608* (2016.02); *E01F 9/681* (2016.02); *E01F 9/685* (2016.02); *E02D 5/80* (2013.01)

(58) Field of Classification Search

CPC ..... E01F 9/011; E01F 9/0111; E01F 9/013; E01F 9/017; E01F 9/0175; E01F 9/627; E04H 12/2253; E04H 12/2269

USPC ..... 404/10; 116/63 R; 40/607.01, 607.1, 40/608, 612

See application file for complete search history.

(56) References Cited

U.S. PATENT DOCUMENTS 3,091,997 A * 6/1963 Byrd ..... E01F 9/681 116/63 P
3,212,415 A * 10/1965 Byrd ..... E01F 9/629 404/10
3,478,715 A * 11/1969 Asbury ..... E01F 9/688 116/63 P (Continued)

*Primary Examiner* — Thomas B Will
*Assistant Examiner* — Katherine J Chu
(74) *Attorney, Agent, or Firm* — Brinks Gilson & Lione

(57) ABSTRACT

A delineator system includes an anchor having an end portion and a post extending along a longitudinal direction and having an end portion overlapping with the end portion of the anchor. The overlapping end portions are coupled together with an engagement member. A protective collar is moveable relative to the post and the anchor along the longitudinal direction from a non-installed position to an installed position. The protective collar is disposed over and covers the overlapping end portions and the engagement member when in the installed position. Methods of manufacturing and installing a post, and other delineator systems and delineator posts are also provided.

18 Claims, 10 Drawing Sheets

(56) References Cited

U.S. PATENT DOCUMENTS 3,902,818 A * 9/1975 Boone ..... E01F 9/61 404/10
4,084,914 A * 4/1978 Humphrey ..... E01F 9/629 256/1
4,240,766 A 12/1980 Smith et al.
4,269,534 A 5/1981 Ryan
4,343,567 A 8/1982 Sarvar et al.
4,364,688 A 12/1982 Bitvai
4,522,530 A 6/1985 Arthur
4,862,823 A 9/1989 Hughes
5,197,819 A 3/1993 Hughes
5,439,311 A 8/1995 Hughes, Jr.
5,452,965 A 9/1995 Hughes, Sr.
5,518,337 A * 5/1996 Modlin ..... E01F 9/675 116/63 R
5,535,555 A 7/1996 Boyd et al.
5,625,988 A * 5/1997 Killick ..... E04H 12/2269 248/156
6,109,820 A 8/2000 Hughes, Sr.
6,257,557 B1 7/2001 Anderson et al.
6,267,529 B1 7/2001 Mudryk et al.
6,422,783 B1 * 7/2002 Jordan ..... E01F 9/685 256/13.1
6,461,084 B1 10/2002 Stuart
6,540,196 B1 * 4/2003 Ellsworth ..... E01F 9/642 248/548
6,709,234 B2 * 3/2004 Gilbert ..... F04D 7/065 403/305
6,719,484 B1 4/2004 Johnson
6,769,833 B2 * 8/2004 Dicke ..... E01F 9/629 40/608
D503,813 S * 4/2005 Steffes ..... D25/133
6,969,212 B1 11/2005 Richens et al.
7,003,919 B2 * 2/2006 Riker ..... E04H 12/2269 52/170
7,185,461 B2 * 3/2007 Lapointe ..... E02D 27/42 248/533
D586,481 S * 2/2009 Blair ..... D25/133
7,722,286 B2 5/2010 Heald
7,794,175 B2 9/2010 Menzel et al.
7,849,617 B2 * 12/2010 Intagliata ..... E01F 9/629 248/160
7,871,221 B2 1/2011 Menzel et al.
8,202,020 B2 6/2012 Hughes, Jr.
8,348,545 B1 1/2013 Hughes et al.
2010/0135722 A1 * 6/2010 Hughes, Jr. ..... E01F 9/681 404/13
2010/0254761 A1 10/2010 Wheeler, Jr.
2010/0277290 A1 * 11/2010 Knudsen ..... E02D 5/226 340/10.52
2012/0126089 A1 * 5/2012 Silvestri ..... E04H 12/2215 248/530
2014/0270940 A1 * 9/2014 Butler ..... E01F 9/0175 404/10
2017/0121997 A1 * 5/2017 Moberg ..... E04H 12/2269

* cited by examiner

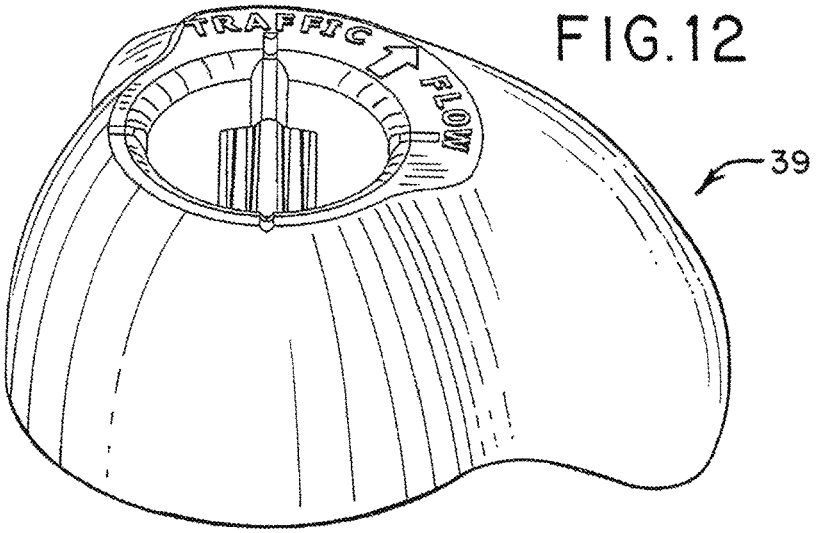
FIG.12
FIG.13a
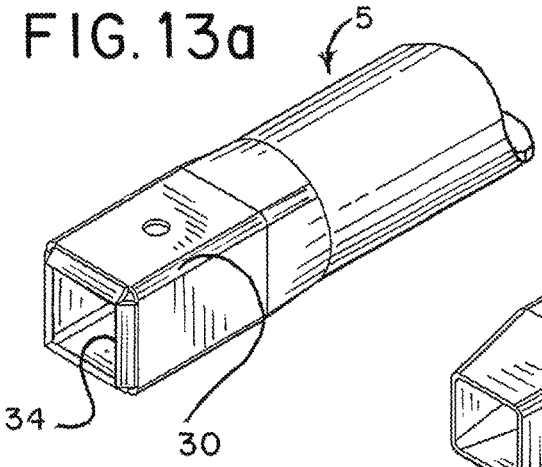
FIG.13b
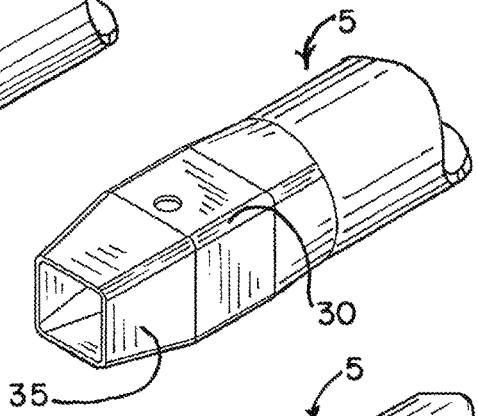
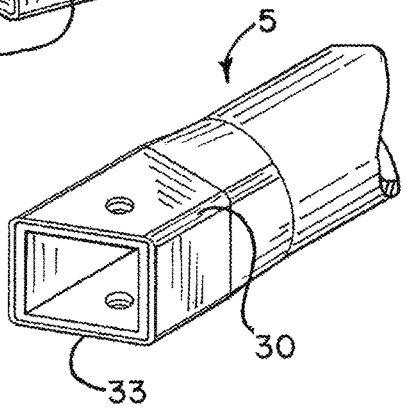
FIG. 13c

SELF-RIGHTING FLEXIBLE DELINEATOR WITH PROTECTIVE COLLAR

This application is a continuation of U.S. application Ser. No. 14/209,020, filed Mar. 13, 2014, which application claims the benefit of U.S. Provisional Application No. 61/779,704, filed Mar. 13, 2013, and also claims the benefit of U.S. Provisional Application No. 61/886,394, filed Oct. 3, 2013, the entire disclosures of which are hereby incorporated herein by reference.

TECHNICAL FIELD

The present invention relates in general to flexible delineators and in particular, to a self-righting traffic control delineator secured to a ground anchor.

BACKGROUND

Flexible traffic control devices, or delineators, used on roadways are frequently struck by vehicles. Repeated strikes by moving vehicles, especially at high speed, may cause damage to delineator marker devices, particularly at the bending area of the device. Frequently, the bending area becomes fatigued and the marker can no longer return to its original, substantially vertical upright position. One type of flexible delineator uses a separate flexible hinge piece that couples a marker portion on one end and a base or anchor on the other end. Such traffic control devices, however, require multiple fasteners to assemble and may therefore be more costly from a manufacturing perspective. The joined areas of such delineators may fail due to the extreme stresses experienced when the delineator is struck by a vehicle moving at a high rate of speed. The hinge section may also be compromised, causing the delineator to lean at an angle less than desirable to effectively delineate traffic or mark an intended obstacle.

SUMMARY

In one aspect, one embodiment of a delineator system includes an anchor having an end portion and a post extending along a longitudinal direction and having an end portion overlapping with the end portion of the anchor. The overlapping end portions are coupled together with an engagement member. A protective collar is moveable relative to the post and the anchor along the longitudinal direction from a non-installed position to an installed position. The protective collar is disposed over and covers the overlapping end portions and the engagement member when in the installed position.

In another aspect, one embodiment of a method of assembling a delineator system includes providing an anchor having a lower portion extending into the ground and an end portion extending upwardly from the ground in a longitudinal direction, moving an end portion of a post in the longitudinal direction into overlapping engagement with the end portion of the anchor, and coupling the end portions of the anchor and the post with an engagement member. The method further includes moving a protective collar downwardly in the longitudinal direction and covering the engagement member and the overlapping end portions.

In another aspect, one embodiment of a delineator post includes an upper portion extending along a longitudinal axis and having a first cross-sectional shape extending orthogonal to the longitudinal axis, and a lower portion integrally formed with the upper portion and having a second cross-sectional shape extending orthogonal to the longitudinal axis. The second cross-sectional shape is different than the first cross-sectional shape. In various embodiments, the first shape is circular, while the second shape is square or star-shaped.

The protective collar improves the performance of the flexible delineator by providing a surface for the delineator to bend around when disturbed by a moving vehicle. All of the parts to put the system into service are assembled by hand without the use of tools to allow for easier and quicker assembly and delineator replacement. The collar also acts as a safety device to cover the sharp edges of the protruding ground anchor so that a vehicle tire puncture hazard is reduced and/or eliminated.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 12 is an isometric view of another embodiment of the protective collar.

FIGS. 13A-C are isometric views showing three different variations of the formed square end of the traffic delineator post.

DETAILED DESCRIPTION OF THE PRESENTLY PREFERRED EMBODIMENTS

It should be understood that the term "longitudinal," as used herein means of or relating to length or the lengthwise direction of a delineator. The term "lateral," as used herein, means directed toward or running perpendicular to the length of the delineator. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" barriers may refer to any sequence of such delineator components, and is not limited to the first and second delineator components unless otherwise specified. The term "rigid" means the ability to resist relative movement between components. The term "flexible" means the ability of components to move relative to each other with little applied force. The term "plurality" means two or more, or more than one.

Figure 1:
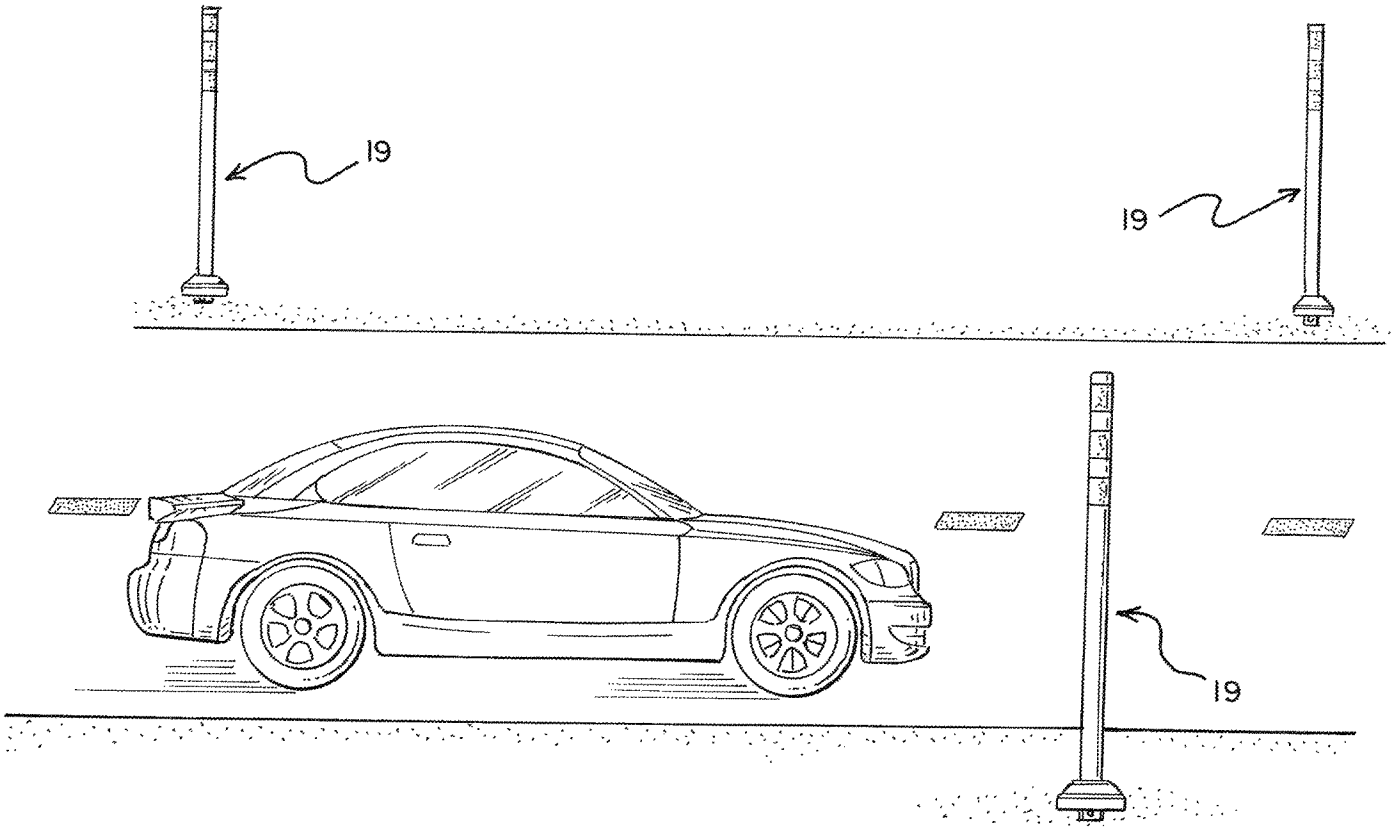
FIG. 1 is a side, perspective view of the delineator system in a typical roadway application.
Figure 2:
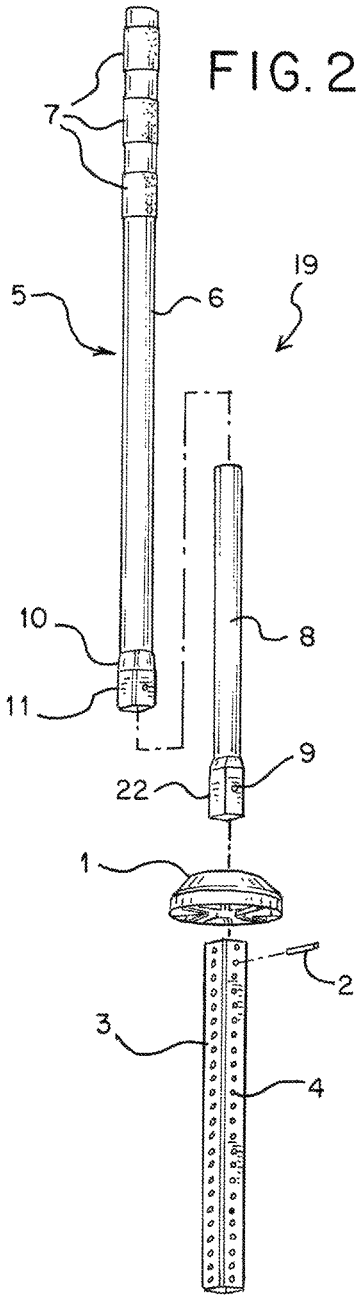
FIG. 2 is an exploded isometric view of an alternative embodiment of the traffic delineator assembly.
Figure 3:
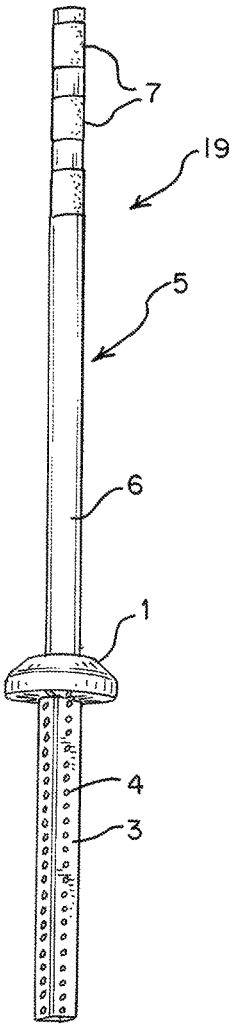
FIG. 3 is an isometric view of one embodiment of the traffic delineator assembly.

Referring to FIG. 2 and FIG. 3, embodiments of a system, method and apparatus for a flexible traffic delineator are shown. A delineator assembly 19, otherwise referred to as a traffic control assembly, for delineating or marking roadways or other marking areas is shown. The embodiment of the traffic control assembly 19 generally includes an anchor 3, an engagement member, shown as a securing pin 2, a protective collar 1, a flexible inner tube 8, and a flexible outer tube 6 that extends substantially vertically from the anchor 3 when in a non-impacted and non-deformed state. The engagement member may alternatively be configured as other types of fasteners, including screws.

The anchor 3 may comprise a square perforated steel tube with equally spaced holes 4 centered along the length on all four sides of the anchor 3. The perforated square steel tubing material is readily available in the roadways to highway/construction market and is commonly used for small sign supports to hold traffic signs and other indices. Alternatively, the anchor 3 may comprise other materials, such as hard plastic. The anchor 3 may also comprise other shapes, such as triangular, or hexagonal, or other multi-sided profiles.

Figure 5:
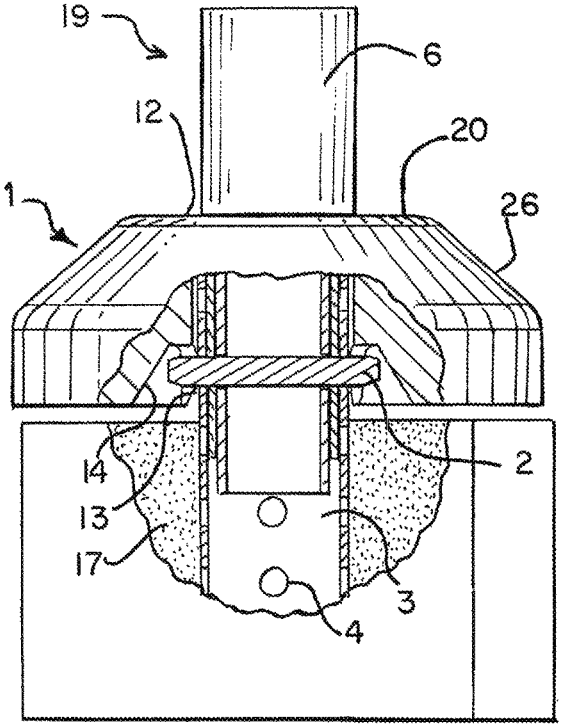
FIG. 5 is a side view of one embodiment of the traffic delineator assembly with a breakout view of the anchor shown embedded in the ground.

The embodiment in FIG. 5, shows the flexible delineator system 19 with the anchor 3 embedded in the earth 17 with the top end of the anchor 3 exposed by substantially 2 to 3 inches to allow for placement of the securing pin 2 and the protective collar 1. Alternatively, the anchor 3 could be embedded in any of various types of medium, such as asphalt or concrete or any variety of soil types that might be found along a typical roadway. The anchor 3 typically would be embedded approximately 18 to 48 inches into the ground, depending on the type and density of medium surrounding the anchor 3.

A number of common tools may be used to drive the anchor 3 into the ground. Of course, if the user were to install the anchor 3 into concrete, the user would extract the earth by approximately 12 inch diameter by 48 inch in depth, pour the concrete into the hole, and insert the anchor 3 into the fresh, uncured concrete, leaving the top 2 to 3 inches exposed for placement of the securing pin 2 and collar 1. It is recommended that the top 3 to 4 inches of the inside cavity of the anchor 3 be left unobstructed so as to be able to insert the square end 11 of the delineator pole 5 into the top, open end of the anchor 3.

The securing pin 2 is generally cylindrical in shape and is made from hard plastic, although the pin may be made from any number of materials, such as metal or even wood, for example. The securing pin may be expandable along a lengthwise direction, such that it is initially compressed and snaps into placed when aligned with the anchor holes. The securing pin 2 fits into hole 13 of anchor 3 and simultaneously into hole 9 of inner tube 8 and hole 10 of outer tube 6 to secure the delineator assembly 5 to the anchor 3. Approximately ⅙ of the length of the securing pin 2 protrudes from each edge of the anchor wall 3. Since the diameter of the securing pin 2 is substantially smaller than the holes 4 in the anchor 3 and the holes 9 in the inner tube 8 and the holes 10 in the outer tube 6, the securing pin 2 can be inserted into position using nothing but hand pressure.

Figure 4:
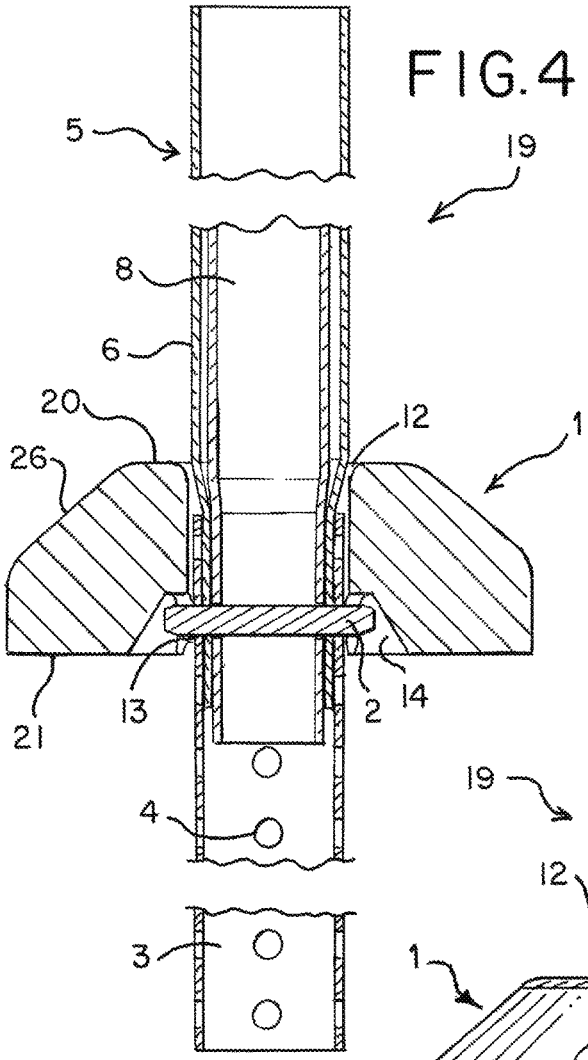
FIG. 4 is a side view cross section of one embodiment of the traffic delineator assembly.

Turning our attention now to FIGS. 4 and 5, the protective collar 1 is generally conical in shape and has a top surface 20 and a bottom surface 21. The shape of the outer surface may be non-circular, for example, octagonal or any other polygonal shape, or could also be irregular or asymmetrical. The top surface 20 of the protective collar has a horizontal flat surface that is approximately one inch wide. The flat top surface 20 then transitions to a steeper angle 26 radially outward towards the outer edge of the protective collar, where it drops off to a substantially vertical angle. This acute angle transition provides for a smooth rollover effect when a vehicle wheels runs over the protective collar. The circular inner edge 12 where the delineator pole contacts is smoothly rounded around the perimeter to provide a smooth surface for the delineator pole 5 to form over during an impact event with a vehicle. As such, the collar has a substantially domed shape, whether linear, curved (rounded) or combinations thereof, wherein the outer surface tapers outwardly from top to bottom.

Figure 6:
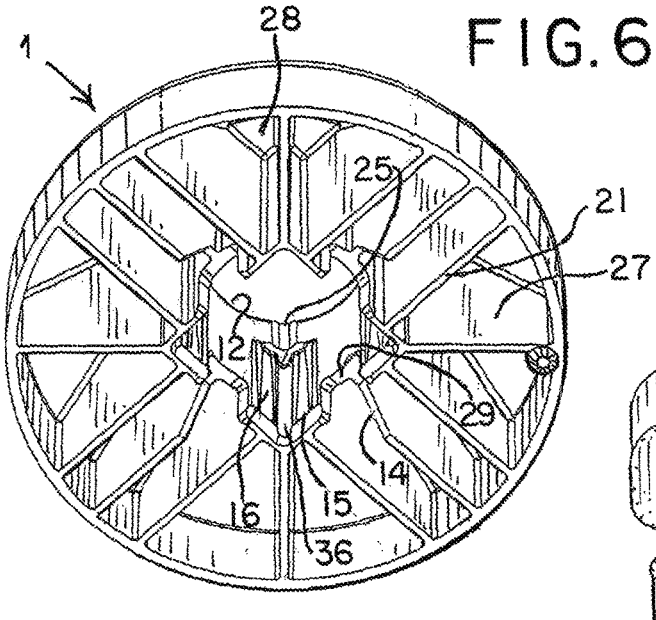
FIG. 6 is an isometric view showing the underside detail of the protective collar.
Figure 7:
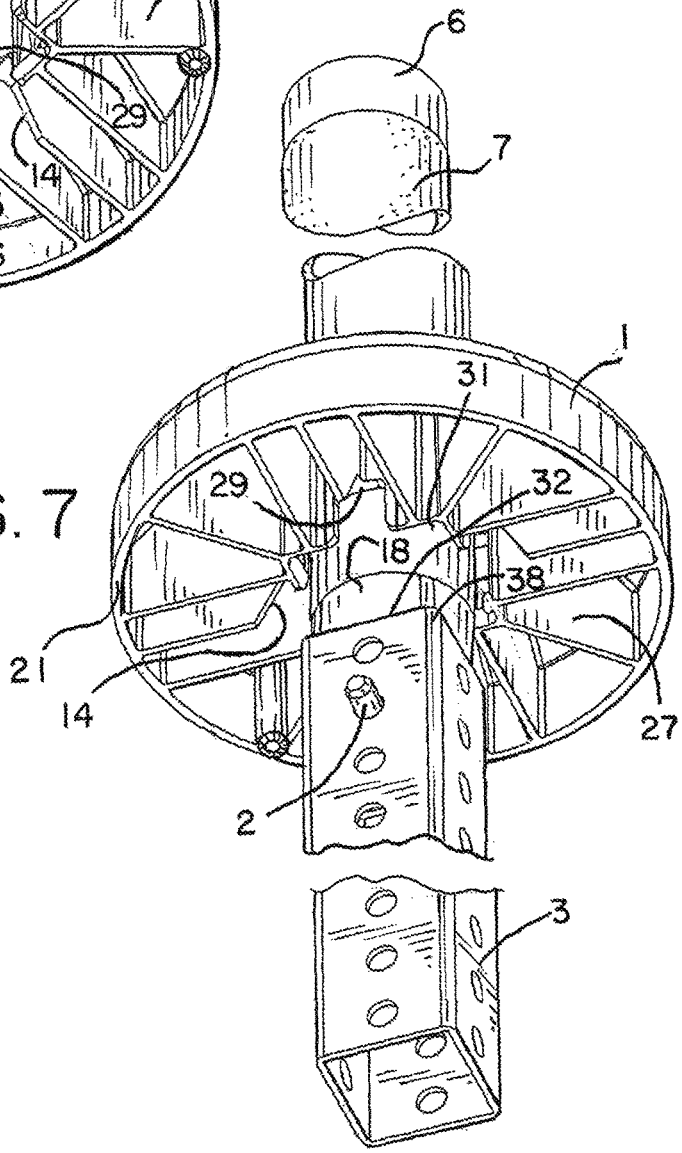
FIG. 7 is an isometric view of one embodiment of the traffic delineator assembly with the protective collar raised to show the delineator fit into the anchor.

As shown in FIGS. 6 and 7, the underside of the protective collar is generally a hollow bowl with a plurality of thin support ribs 27 extending down to the surface of the hollow inner shell 28. The support ribs are a common feature on injection molded plastic parts. The molded-in ribs provide support structure while utilizing a minimal amount of resin material to make the part.

The protective collar bottom surface 21 is generally flat. The four ribs along the XZ and YZ planes of the part have cutout openings 14 which allow the protective collar to pass over the securing pin 2. Four opposing openings 14 equally spaced around the protective collar 1 contain the securing pin 2 when the protective collar 1 is resting in its serviceable position. Additionally, four notches 29 formed in walls 15 defining a central opening allow the protective collar 1 to pass over the securing pin 2 and post 3, with notches 29 and openings 14 being in communication. The inside surface of the ribs that define the cutout opening 14 are at an obtuse angle to align the securing pin 2 if it is off center during the installation of the protective collar 1 onto the anchor 3. The squared mating portion of the protective collar 1 is symmetrical about its vertical axis which allows the protective collar 1 to be installed in either vertical plane of the anchor. This symmetrical feature also makes installation easier for the user by allowing the user to set the protective collar 1 in place without paying particular attention to the orientation of the protective collar onto the anchor 3.

In one embodiment when the protective collar 1 is in its installed, serviceable position, the bottom surface of the protective collar 21 contacts the ground surface. In another embodiment, the protective collar 1 is spaced a certain distance from the ground, for example, if the anchor was installed such that more than 2 to 3 inches of anchor was protruding from the ground. In yet another embodiment, the anchor is installed on unlevel soil, such as on a slope, which leaves an uneven gap between the bottom surface of the protective collar 1 and the ground surface. In any of these cases, the delineator system will perform correctly as described herein.

In yet another embodiment, the anchor is installed such that less than 2 to 3 inches protrudes from the ground surface. To align the protective collar with the hole in the anchor, the soil around the anchor must be removed, causing the bottom surface of the protective collar to be below grade. Again, in this case, the delineator system will perform correctly as described herein.

The protective collar 1 is made from hard plastic such as high impact polystyrene (HIPS), but could be made from any number of materials such as metal or wood or other hard plastics or even firm rubber. The opening at the top side 20 of the protective collar 1 is circular in shape to accept the cylindrical shape of the delineator tube 6. Equally spaced around the perimeter of the opening are four notches 25 approximately ¼ inch deep. These notches 25 allow for passage of the square edges 30 of the lower portion of the outer tube 6 to pass through. The opening 31 at the bottom side 21 of the protective collar 1 has square shaped corner recesses 15 to accept the exposed end of the anchor 3. The protective collar may also be configured to fit other shapes of anchors, such as round or U-Channel or any number of various shapes, which are commonly used in the transportation industry as roadside hardware. When the protective collar 1 is installed onto the anchor 3, the shelf 16 rests on the top surface 32 of the anchor 3 and prevents the protective collar 1 from dropping below its prescribed, effective height. In this embodiment, the protective collar 1 is not secured in place with any fasteners, instead it remains in place only by the friction between the contact surfaces between the protective collar 1 and the outer surfaces of the anchor 3. The outer surface of the protective collar 1 is round, but the shape could be other profiles, such as oval or rectangular or a shape having a plurality of flat sides, such as a polygon or even an irregular non-symmetrical shape.

Figure 15:
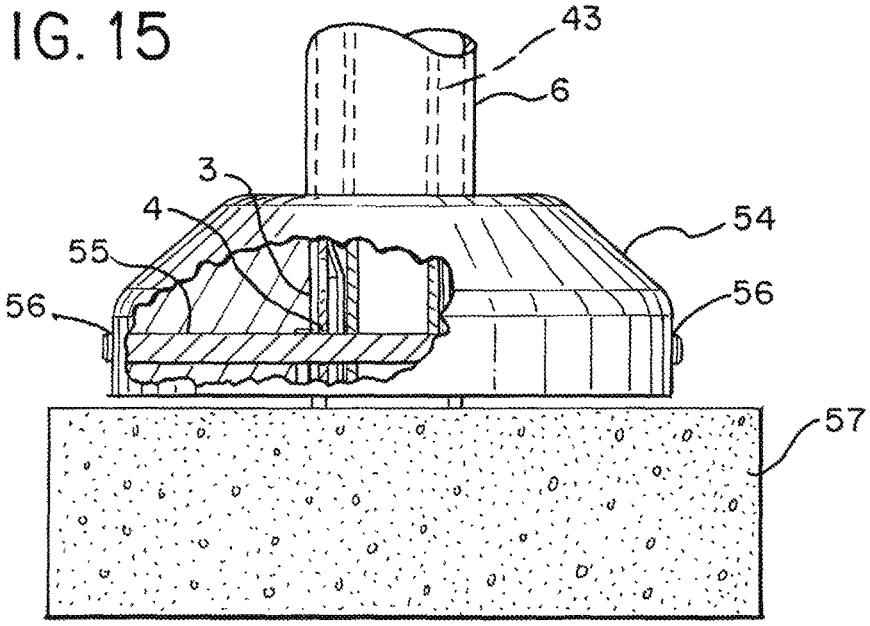
FIG. 15 is a breakout view showing the inside detail of the protective collar secured to the anchor with a pin.

Referring to FIG. 15, in another embodiment of the delineator system, the protective collar 54 is secured to the anchor 3 with the use of a pin 55. This embodiment would be useful in applications where the user desires to protect the systems from mischief or vandalism, for example. The securing pin 55 is long enough such that it captures the protective collar 55 and all of the parts of the assembly, meaning the anchor 3, outer tube 6 and inner tube 43. Once the delineator tubes 6, 43 are aligned with the hole 4 in the anchor 3, The protective collar 54 is placed onto the anchor 3 so that the holes 56 in the protective collar 55 are aligned with the holes 4 in the anchor 3 and the delineator tubes 6, 43. Then, the pin 55 is driven into position with a striking tool, such as a hammer. The securing pin 55 is sized such that the hole 56 in the protective collar 54 is slightly undersized. The securing pin 55 remains in place by friction between the securing pin 55 and the hole 56 in the protective collar 54.

Figure 16:
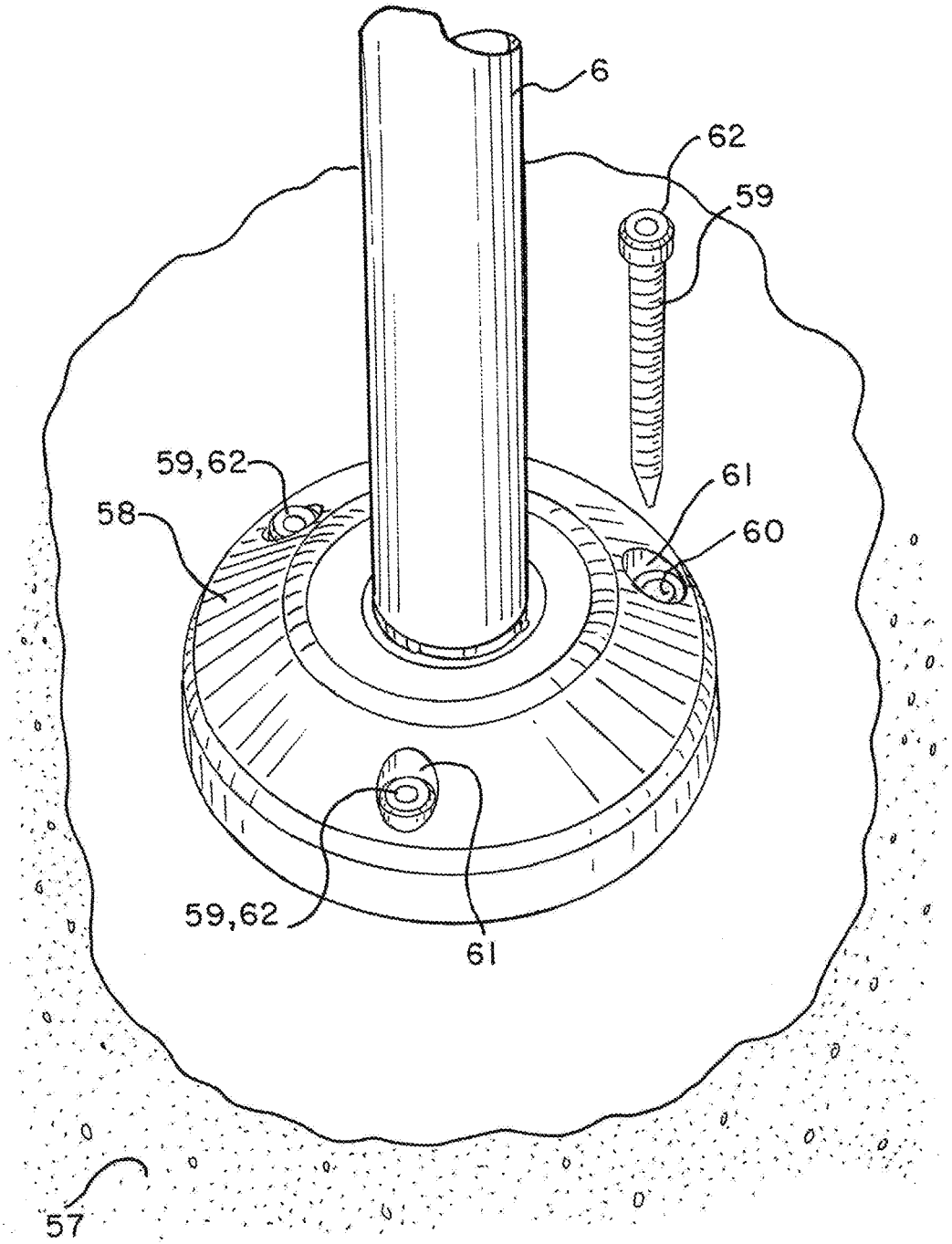
FIG. 16 is a perspective view showing the protective collar secured to the soil with ground stakes.

In yet another embodiment of the delineator system, the protective collar 58 is secured in place with the use of soil stakes 59 as illustrated in FIG. 16. A plurality of soil stakes 59 are placed through holes 60 in the protective collar 58 and driven into the soil 57 with a hammer or similar striking tool. The protective collar 58 is outfitted with recesses 61 that allow the head 62 of the soil stake 59 to rest below the outer surface of the protective collar 58. The term "stake" refers to a component extending through or from the cover into an underlying substrate, whether soil, asphalt or concrete, and includes without limitation soil stakes, screws, nails, pins, asphalt and concrete anchors and other types of fasteners. In other embodiments, the cover may be secured to the ground substrate by bonding or with adhesives.

The delineator tube assembly 5 consists of an outer tube 6 and an inner tube 8. The inner tube 8 has a smaller diameter than the outer tube 6, so that the inner tube 8 can nest inside the outer tube 6. The delineator is made from low density polyethylene, including linear low density polyethylene, which allows it to be flexible and yield when struck by a vehicle. Other flexible materials could also be used for the delineator. The inner tube 8 provides support to help return the outer post 6 back to a vertical position after the vehicle passes over it. Reflective tape 7 can be applied to the outer tube 6 to aid in making the delineator 5 more visible, especially at night. Alternatively, other indices, such as signs can be mounted to the delineator 5.

In one embodiment, the lower end of the delineator 5 is formed into a square shape 11, 22 so that it can be inserted into the anchor 3. The outside dimensions of the square portion of the delineator are slightly smaller than the inside dimensions of the square steel anchor 3 so that the delineator 5 slips easily into the opening of the anchor 3. The delineator 5 is inserted into the anchor 3 a distance of approximately two to three inches or about where the delineator transitions from square to round 18. To aid in inserting the delineator 5 into the anchor opening 32, the end of the delineator can be cut at an angle 33 as shown in FIG. 13C. The delineator may alternatively have an opening shaped to receive the anchor in the delineator, with a pin securing one to the other. Another method of making the delineator 5 easier to insert into the anchor opening is to form the ends inwards 34 as shown in FIG. 13A. And yet another method to make insertion of the delineator 5 into the anchor easier is to form the square end into a taper 35 as shown in FIG. 13B. Of course there are numerous shapes and geometries that would be suitable for forming the end of the delineator to make insertion into the anchor easier.

Figure 14:
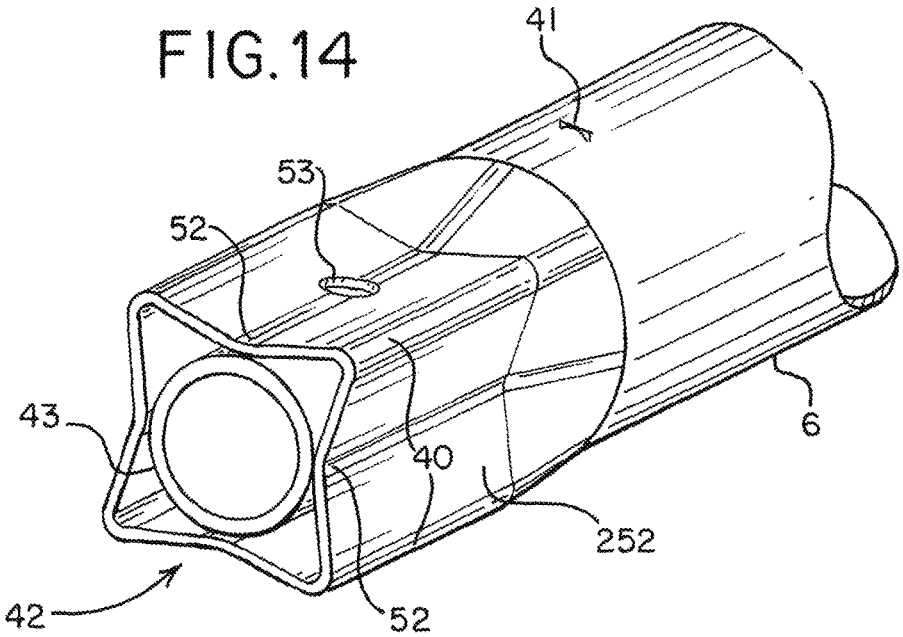
FIG. 14 is an isometric view showing a star shape of the formed end of the traffic delineator post.

Referring to FIG. 14, the end of the tube may be configured with a number of pleats, folds, valleys or bends 52 formed in one or more sides 252 so as to promote the deformability of the end portion, such that the tube is inwardly compressible, for example by manually gripping and squeezing the end portion such that it may be more easily inserted into the open end of the anchor. The pleats, folds, valleys or bends 52 define living hinges that enhance the lateral flexibility of the end portion, such that the area of the cross-sectional shape defined by the outer periphery of the end portion is reduced as the end portion is inwardly compressed. The pleats, folds or bends are formed in the sides, with the sides bowing, or protruding inwardly toward the longitudinal axis. The sides meet at junctions, shown as four corners in one embodiment, although it should be understood that more or fewer corners may be provided. In one embodiment, the end portion is formed with a generally star-shaped cross section, as shown in FIG. 14. It should be understood that the term "star-shaped" includes shapes having various combinations of sharp (pointed) and soft (curved) outer corners (peaks) and/or sharp or curved inner pleats/bends (valleys), and different combinations thereof, meaning for example a star-shaped cross section may have a clover leaf appearance, and may have 3 or more peaks. The various shapes allow for a broader tolerance range of the outside dimensions of the formed portion. For example, if the outside width dimension of the formed end is larger than the inside width dimension of the anchor into which the delineator is to be inserted, the user can simply squeeze or pinch the corners 40 to diminish the cross-sectional dimension, or diagonals, of the end portion, making it smaller such that it fits into the anchor opening 32. A smaller diameter inner tube 43 may be inserted into the interior passageway of the outer delineator tube 6. Two opposing fasteners, such as staples 41, may be provided to secure the inner tube 43 to the outer tube. With some formed shapes, such as those described in FIGS. 13A-C, the forming process may be performed with the inner tube in place. However, the star shaped end portion may require greater pressures, such that the forming process may be simplified if the inner tube 43 is not present within the delineator during the forming process, but assembled afterwards.

Typically, the extrusion process, from which the delineator tubes are made, is limited in that it can only form a single shape along the entire length of the tube. In the present embodiments, the shape of the tube at the lower end that connects to the anchor is different than the upper portion; i.e. the upper portion of the delineator tube is round, then it transitions to a generally square or other shape. Therefore, it is necessary to create the necessary shape of the lower end of the delineator tube. In one embodiment, the generally square or star shape of the delineator 11, 22, 42 is formed by heating the end of the delineator 6 to approximately 200° F., then placing the end of the delineator 6 into a forming jig that compresses the tubes into the desired shape and holding it there until it cools. Of course cooling liquid or forced air could be applied to the heated delineator to speed up the forming process.

One method for heating the plastic tube to a high enough temperature that allows the material to be soft and pliable is performed by placing the plastic into heated water that is near boiling temperature (about 200 degrees Fahrenheit), then immediately put the tube into a form or mold that is the desired shape and letting it cool so that it holds its final shape. The cooling time could be sped up by applying cold water of approximately 40 degrees Fahrenheit to the part while it is in the form. Other methods to heat and cool the formed section of the delineator may be used.

Figure 17:
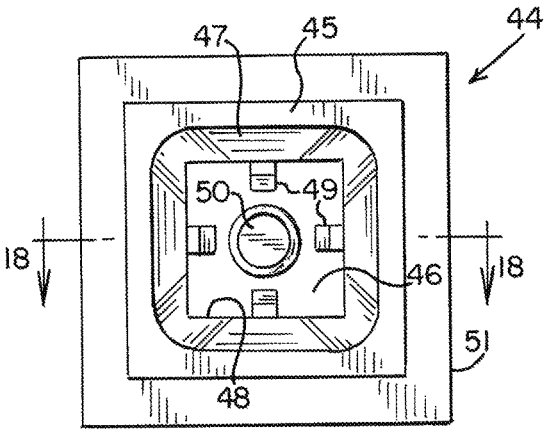
FIG. 17 is a top view of the star shape tube forming fixture.
Figure 18:
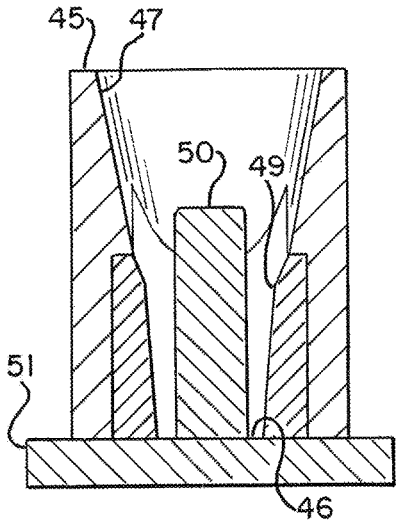
FIG. 18 is a cross section view along line 18-18 of FIG. 17.
Figure 19:
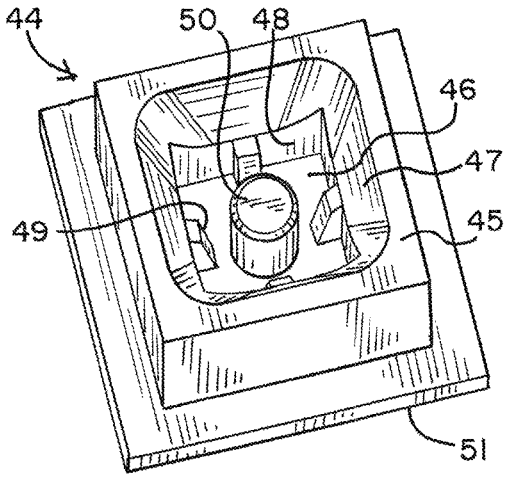
FIG. 19 is a perspective view of the star shape tube forming fixture.

Referring to FIGS. 17-19, a forming fixture 44 is shown for forming the tube into a generally star shape 42. The forming fixture has a top surface 45, bottom surface 46, an opening 47 to accept the heated, pliable end of the delineator tube 6, star shape forming wall 48, notching ribs 49 and a center support stem 50. The lower portion of the delineator tube is submerged in 200° F. hot water for approximately 25 to 30 seconds. Hot water may be greater or less than 200° F., so long as it is at a sufficient temperature to make the material more soft and pliable. The tube 6 is then removed from the hot water and inserted into the opening 47 of the star shape forming fixture 44 until the bottom of the tube 6 contacts the bottom 46 of the fixture 44. As the tube is pressed into the fixture 44, the notching ribs 49 create a valley 52 in the wall of the tube 6 as shown in FIG. 14. Likewise, the star shape 42 and corners 40 of the tube 6 are formed in this manner. The support stem 50 contacts the inner surface of the tube 6 to prevent the walls of the tube 6 from collapsing. Now the fixture 44 with the tube 6 in place is quenched in about 40° F. chilled water for about 25 to 30 seconds. Other temperatures of cold water, less than or greater than 40° F. would also work, with cold water being generally less than 70° F. The chilled water rapidly cools the assembly to shorten the process time. Once the post is cool its shape will be retained for an indefinite period of time. With the lower end of the delineator tube formed into its desired shape, the inner tube 43 is positioned inside the tube 6 and is then secured with staples 41. Finally, a hole 53 is punched or drilled through the entire assembly. Of course other methods of heating, such as open flame, infrared or induction heating could be used as well as other forms of cooling, such as cool air, compressed liquid nitrogen or other industrial gas, for example. The fore described forming method is not restricted to the star shape, but can be used for any conceivable shape.

Figure 8:
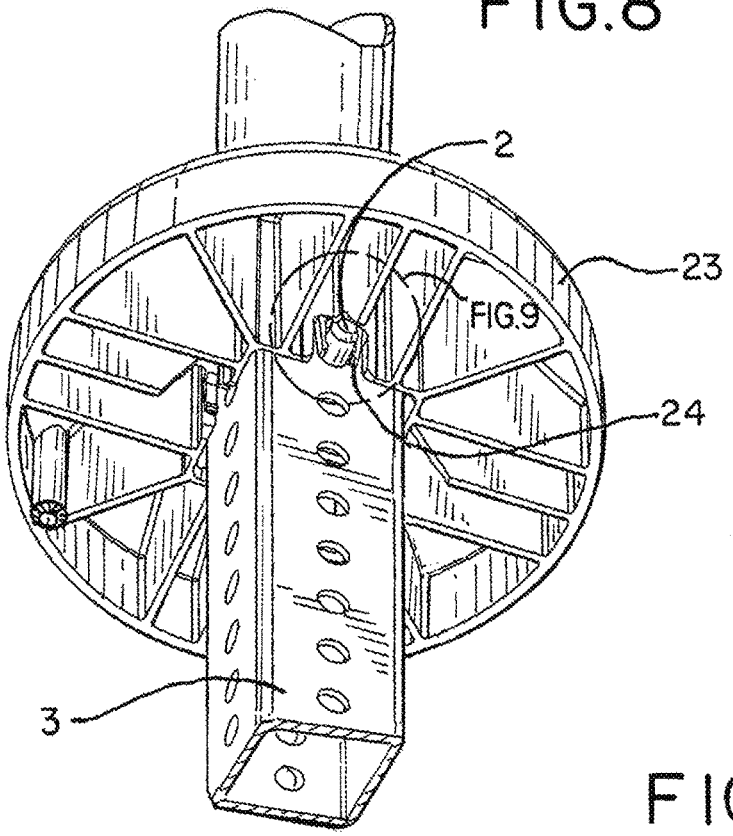
FIG. 8 is an isometric view of another embodiment of the traffic delineator assembly with a protective collar outfitted with securing snaps.
Figure 9:
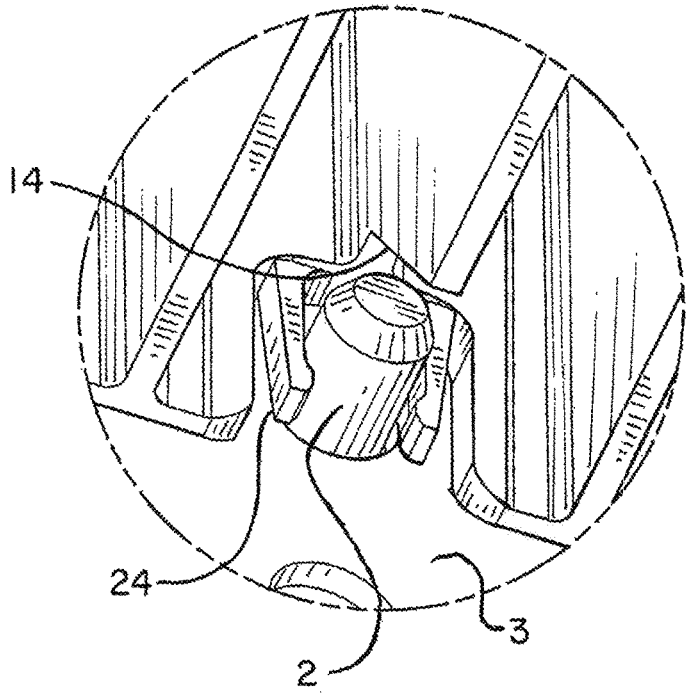
FIG. 9 is an isometric view showing the underside detail of the protective collar securing snaps.

In another embodiment shown in FIGS. 8 and 9 the collar 23 is equipped with locking fingers 24 that grip the securing pin 2. In this embodiment, the connection between the protective collar 23 and the pin 2 helps hold the protective collar 23 in place. However, no securing is required in other embodiments, with the protective collar 1 not expected to move or dislodge under normal service. During the installation of the protective collar 23, the user will know when the protective collar 23 is in place by the feel of the fingers 24 as they grip and lock around the pin 2. It is noted that the fingers 24 will not prevent the pin 2 from moving along its longitudinal axis, rather, the protrusions 14 will act as a keeper as was previously described.

Figure 11:
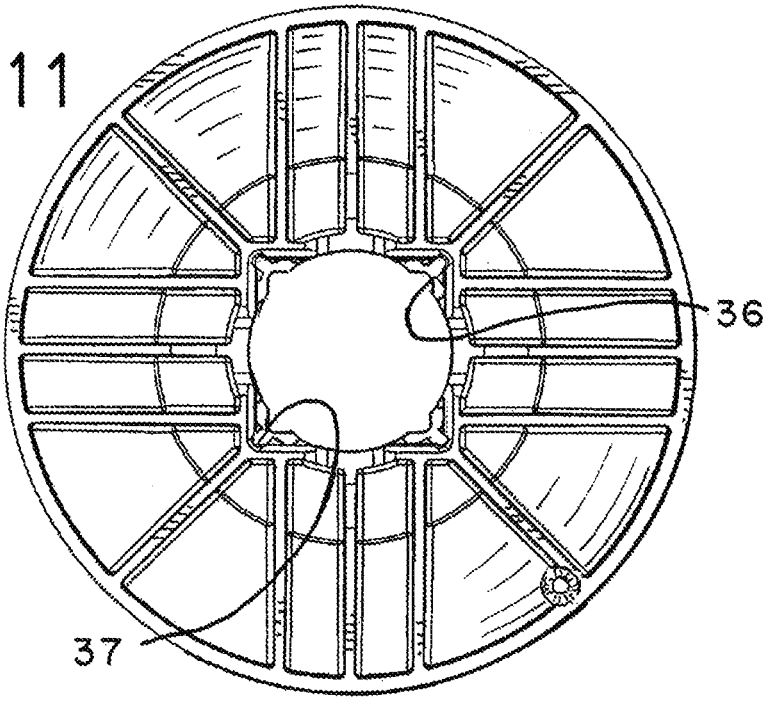
FIG. 11 is a bottom view showing the underside detail of one embodiment of the protective collar.

Turning our attention now to the square opening detail of the protective collar shown in FIG. 11. A plurality of longitudinal tapered protrusions 36 are provided to accommodate dimensional variances at the opening of the anchor 32. The anchors are typically installed into the soil with standard impact driver tools, which can distort and flatten the top surface 32 of the anchor. The distortions can be severe enough that they would be outside the dimensions of the square opening 32; preventing the protective collar 1, 23 from fitting over the anchor 3. To allow the protective collar 1, 23 to fit a wide range of anchor opening tolerances, thin, longitudinal protrusions 36 exist on the walls 15 of the square opening 31. As the protective collar 1, 23 is placed over the open end of the anchor 32 the longitudinal, tapered protrusions contact the anchor opening as necessary. As more downward force is applied to the protective collar 1, 23 the edges of the open end of the anchor 32 scrape away the protrusions, which provides a snug fit between the anchor 3 and the protective collar 1, 23.

Another design feature of the protective collar square opening 32 which provides easy placement of the protective collar onto the anchor is the relief in the corners of the square opening 37. As described earlier, the top surface 32 of the square anchor 3 tends to distort and flatten during installation. The distortion and flattening is often most severe at the corners 38 of the anchor 3. Providing an opening in the protective collar for the distorted anchor corners will help with making the protective collar easier to install onto the square steel tube.

Figure 10:
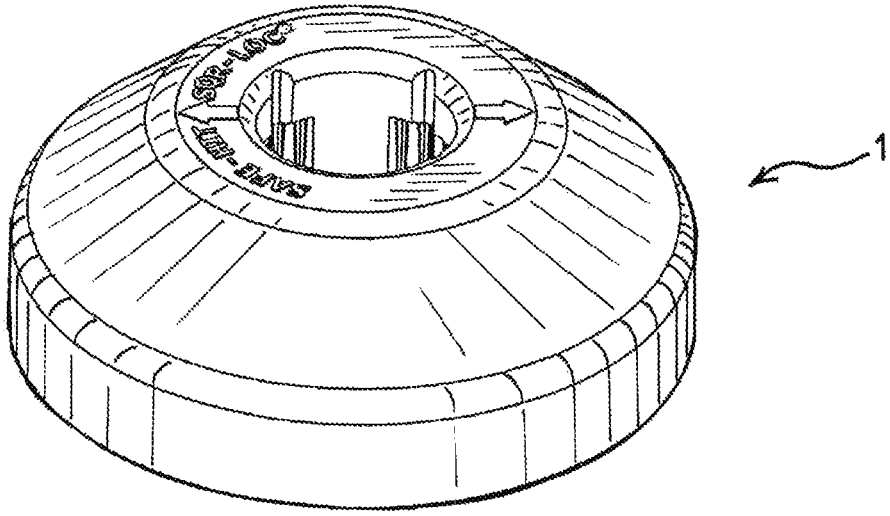
FIG. 10 is an isometric top view of one embodiment of the protective collar.

Turning now to the shape of the outer surface of the protective collar 1 as shown in FIG. 10, a fully circular, or similar symmetrical shape, such as a polygon, may be useful for delineators that are placed in applications that could get run over by vehicles from any direction 360 degrees from the vertical long axis of the delineator, such as in the center lane of a two or more lane highway. However, there are many applications for delineators where the delineators are only struck by vehicles traveling in one direction, such as on the right hand side of the road. In these applications it may be desirable to have a protective collar that supports the delineator only in the direction that the delineator would bend. One concept of such a protective collar 39 is shown in FIG. 12. The shape of such a protective collar is smaller than a full 360 degree shaped protective collar, thus it would utilize less material in its manufacture and therefore be less costly to produce.

The protective collar has a top surface and bottom surface and has a portion that is generally dome shaped, with a generally flat upper portion having a rounded corner adjacent the opening. In one embodiment, the collar is made from hard plastic, although it could be made from metal or any other strong, rigid material. The collar has a circular opening at the top surface to receive the tubular flexible delineator pole. The bottom surface of the collar has a square shaped opening that has a larger dimension than the outside dimension of the square steel anchor so that it can slip over the top surface of the square steel anchor tube. The protective collar could also be designed to fit other shapes of anchors, such as round or U-Channel or any number of various shapes, which are commonly used in the transportation industry as roadside hardware.

In one embodiment, the flexible delineator pole is a two-piece plastic system having an outer tube and an inner tube. The inner tube helps the outer tube return to a vertical position, when the pole is struck by a vehicle, by providing support so that the outer tube does not collapse upon itself, as disclosed for example in U.S. Pat. No. 4,343,567, Sarver, et al., the entire disclosure of which is hereby incorporated herein by reference. The lower end of the two-piece flexible delineator pole is a square shape that is smaller than the inside dimensions of the square steel anchor so that the pole slips inside the upper end of the anchor. The delineator pole has a through-hole to accept the securing pin.

In operation, to place the flexible delineator system into service, the square steel anchor is driven into the earth until about 2 to 3 inches of the top of the anchor remains above the earth surface. The collar is placed onto the lower end of the flexible delineator outer tube. Then the flexible delineator pole, complete with the outer tube and the inner tube, is inserted into the top end of the square steel anchor and pushed down until the holes in the pole and the holes in the anchor are aligned. The cylindrical pin is then inserted into the anchor until it passes through the delineator pole and sticks out through the opposing end of the square steel anchor. When in service position, the securing pin ends extend approximately one-half inch past the anchor wall on both ends. The collar is then slid down over the upper end of the square steel anchor until it rests on the top surface of the anchor. The protective collar has openings in the bottom surface that capture the securing pin. These openings are in line with the long axis of the securing pin and prevent the securing pin from coming out of the hole in the anchor.

One advantage of this system is that the delineator can be easily assembled by hand without the use of any tools. This aids the installer during initial assembly and when the flexible delineator pole has reached its serviceable life and requires replacing. Another advantage of this invention over prior art is the absence of extra hardware, such as cotter pins and threaded fasteners, used to hold the securing pin in place. Generally, the spent delineator pole can be easily extracted from the anchor by hand, without the use of tools. And the anchor, securing pin and protective collar can be reused indefinitely. Advantageously, the protective collar does not require a pin or other fastening device required to hold the protective collar in place. This allows for easy assembly and maintenance of the delineator system. However, in certain applications it may be desirable to fix the protective collar to the anchor or the ground. In this case, fasteners, pins or stakes could be used to secure the protective collar to either the anchor or the ground as desired by the user.

In operation, when struck by a moving vehicle, the flexible delineator pole will deflect until the vehicle has passed over it. The securing pin holds the delineator pole in place and prevents it from releasing from the anchor. The protective collar provides support for the delineator pole as the delineator pole bends at a substantially 90° angle from the vertical position. The top surface of the protective collar has a flat ledge with smooth, rounded edges, which provides support for the delineator pole at the bending area and prevents it from kinking so that it can return to its original substantially vertical position. Tests have shown that without the protective collar present, the delineator pole may contact the top edge of the anchor, causing it to permanently kink, distort or cut, and prevent the delineator from returning to a substantially vertical position. The addition of the protective collar allows the flexible delineator pole to be impacted by a moving vehicle a multiple number of times and remain in useful service for an extended period, requiring no maintenance.

In addition, the protective collar protects the sharp edge of the exposed end of the anchor from pinching and cutting the delineator during the action of the vehicle tires rolling over the delineator pole. Additionally, the protective collar is advantageous to cover the sharp edges of the protruding anchor to prevent a vehicle tire from getting damaged on the sharp edges, even when the delineator pole is not present in the anchor. The delineator anchors are frequently installed in areas along the sides of roads where weeds grow. Typically, when maintenance crews mow the weeds, they damage or destroy the delineator post with their mowing machines because the weeds grow next to and all around the delineator post. The addition of a protective collar will help prevent the weeds from growing next to the delineator and provide a weed-free moat that lets the maintenance crew know not to mow too close to the delineator. This weed-free moat can be broadened with the addition of a mat, such as rubber or plastic, located underneath the protective collar and delineator securing pin.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A delineator system comprising:

an anchor having an end portion;

a one-piece post extending along a longitudinal direction and comprising an uppermost end portion having an exterior surface exposed to the ambient environment, said one-piece post having a bottom end portion overlapping with said end portion of said anchor, wherein said bottom end portion and said end portion of said anchor are coupled together with an engagement member, wherein said engagement member comprises a pin inserted through said bottom end portion and said end portion of said anchor, wherein said one-piece post is bendable between an upright configuration and a deflected configuration in response to an impact, wherein said anchor remains stationary when said one-piece post is bent between said upright configuration and said deflected configuration, and wherein said bottom end portion of said one-piece post and said end portion of said anchor remain coupled when said one-piece post is bent between said upright configuration and said deflected configuration, and wherein said one-piece post is resilient and flexible such that said one-piece post will return to said upright configuration from said deflected configuration after said impact; and a one-piece protective collar having an upper surface, a bottom surface and a longitudinally extending through opening communicating between said upper and bottom surfaces, said protective collar being moveable relative to said post and said anchor along said longitudinal direction from a non-installed position to an installed position, wherein said protective collar is disposed over and covers said overlapping bottom end portion and said end portion of said anchor and opposite ends of said pin when in said installed position, wherein said protective collar prevents said pin from being removed from said anchor and said one-piece post when said protective collar is in said installed position, and wherein said pin may be removed from said one-piece post and said anchor when said protective collar is in said non-installed position, and wherein said end portion of said one-piece post is insertable from said upper surface of said protective collar in said longitudinal direction into said through opening.

2. The delineator system of claim 1 wherein said protective collar is releasably coupled to said pin when in said installed position.

3. The delineator system of claim 1 wherein said end portion of said anchor has a substantially square cross-section.

4. The delineator system of claim 3 wherein said bottom end portion of said one-piece post has a substantially square cross-section.

5. The delineator system of claim 3 wherein said bottom end portion of said one-piece post comprises a generally star-shaped cross-section.

6. The delineator system of claim 1 wherein said end portion of said anchor defines an opening, and wherein bottom said end portion of said one-piece post is inserted into said opening.

7. The delineator system of claim 1 wherein an upper portion of said one-piece post has a different cross-section than said bottom end portion.

8. The delineator system of claim 4 wherein said longitudinally extending through-opening has a generally circular shape adjacent an upper portion of said protective collar and a square shape adjacent a lower portion of said protective collar.

9. The delineator system of claim 1 wherein a portion of said upper surface of said protective collar is substantially dome shaped.

10. The delineator system of claim 9 wherein another portion of said upper surface is substantially flat.

11. The delineator system of claim 1 wherein said collar comprising a curved shoulder transitioning between said upper surface and said through opening.

12. The delineator system of claim 1 further comprising a plurality of stakes extending longitudinally through said protective collar, wherein said plurality of stakes are adapted to penetrate the ground underlying said protective collar.

13. The delineator system of claim 1 wherein at least a portion of said bottom end portion of said one-piece post is positioned below said bottom surface of said protective collar when said protective collar is in said installed position.

14. The delineator system of claim 1 wherein said end portion of said anchor extends upwardly through said bottom surface of said protective collar into said longitudinally extending through opening.

15. The delineator system of claim 14 wherein said protective collar comprises a shelf disposed in said through opening, and wherein an upper surface of said end portion of said anchor engages said shelf when said protective collar is in said installed position.

16. A delineator system comprising:

an anchor having an end portion;

a one-piece post extending along a longitudinal direction and comprising an uppermost end portion having an exterior surface exposed to the ambient environment, said one-piece post having a bottom end portion overlapping with said end portion of said anchor, wherein said bottom end portion and said end portion of said anchor are coupled together with an engagement member, wherein said engagement member comprises a pin inserted through said bottom end portion and said end portion of said anchor, wherein said one-piece post is bendable between an upright configuration and a deflected configuration in response to an impact, wherein said anchor remains stationary when said one-piece post is bent between said upright configuration and said deflected configuration, and wherein said bottom end portion of said one-piece post and said end portion of said anchor remain coupled when said one-piece post is bent between said upright configuration and said deflected configuration, and wherein said one-piece post is resilient and flexible such that said post will return to said upright configuration from said deflected configuration after said impact; and a one-piece protective collar having an upper surface, a bottom surface and a longitudinally extending through opening communicating between said upper and bottom surfaces, said protective collar being moveable relative to said one-piece post and said anchor along said longitudinal direction from a non-installed position to an installed position, wherein said protective collar is disposed over and covers said overlapping bottom end portion and said end portion of said anchor and opposite ends of said pin when in said installed position, wherein said protective collar prevents said pin from being removed from said anchor and said one-piece post when said protective collar is in said installed position, and wherein said pin may be removed from said one-piece post and said anchor when said protective collar is in said non-installed position, and wherein said end portion of said one-piece post extends downwardly from said upper surface of said protective collar in said longitudinal direction into said through opening when said protective collar is in said installed position, and said end portion of said anchor extends upwardly from said bottom surface of said protective collar in said longitudinal direction into said through opening when said protective collar is in said installed position.

17. The delineator system of claim 16 wherein at least a portion of said bottom end portion of said one-piece post is positioned below said bottom surface of said protective collar when said protective collar is in said installed position.

18. The delineator system of claim 16 wherein said protective collar comprises a shelf disposed in said through opening, and wherein an upper surface of said end portion of said anchor engages said shelf when said protective collar is in said installed position.

* * * * *